US006838230B2

(12) United States Patent
Wan et al.

(10) Patent No.: US 6,838,230 B2
(45) Date of Patent: Jan. 4, 2005

(54) METHOD FOR PROCESSING A DIGITALLY EXPOSED TRANSLUCENT OR TRANSPARENT PHOTOGRAPHIC MATERIAL

(75) Inventors: Hai-xing Wan, Ramsey, NJ (US); Robert S. Harvey, Rockaway, NJ (US)

(73) Assignee: Fuji Hunt Photographic Chemicals, Inc., Allendale, NJ (US)

( * ) Notice: Subject to any disclaimer, the term of this patent is extended or adjusted under 35 U.S.C. 154(b) by 0 days.

(21) Appl. No.: 10/247,705

(22) Filed: Sep. 20, 2002

(65) Prior Publication Data

US 2004/0063043 A1 Apr. 1, 2004

(51) Int. Cl.[7] ..... G03E 7/407
(52) U.S. Cl. ..... 430/363; 430/490
(58) Field of Search ..... 430/363, 490, 430/441, 442

(56) References Cited

U.S. PATENT DOCUMENTS

| | | | | |
|---|---|---|---|---|
| 4,965,175 | A | 10/1990 | Fujimoto et al. | |
| 5,066,571 | A | 11/1991 | Yoshida et al. | |
| 5,077,180 | A | 12/1991 | Yoshida et al. | |
| 5,094,937 | A | 3/1992 | Morimoto | |
| 5,178,992 | A | 1/1993 | Yoshida et al. | |
| 5,248,811 | A | 9/1993 | Morimoto | |
| 5,262,563 | A | 11/1993 | Morimoto | |
| 5,445,924 | A * | 8/1995 | Kawai | 430/363 |
| 5,981,111 | A * | 11/1999 | Irita et al. | 430/7 |
| 6,194,135 | B1 | 2/2001 | Ly et al. | |
| 6,413,703 | B1 * | 7/2002 | Tappe et al. | 430/466 |
| 6,458,520 | B2 * | 10/2002 | Ishikawa et al. | 430/434 |
| 2002/0009679 | A1 | 1/2002 | Yoshida et al. | |

FOREIGN PATENT DOCUMENTS

JP 11-65054 A 3/1999

OTHER PUBLICATIONS

Search Report issued in European Patent Application No. EP 03 25 5915, dated Dec. 17, 2003.

* cited by examiner

*Primary Examiner*—Hoa Van Le
(74) *Attorney, Agent, or Firm*—Burns, Doane, Swecker & Mathis LLP

(57) ABSTRACT

A method is provided that is suitable fur use in processing a digitally exposed translucent or transparent display material. The method includes exposing a translucent or transparent material to light emitted from a light source. The material contains at least one silver halide having a silver content of at least about 1 g/m$^2$ based on the area of the material. The method also includes contacting the material with a color developer solution comprising at least one color developing agent and a compound having the following formula (I):

Formula (I)

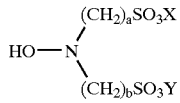

in which each of a and b independently represents 1 to 4, and in which each of X and Y independently represents a hydrogen, sodium or potassium atom. The duration of the step (b) is from about 60 to about 180 seconds.

17 Claims, No Drawings

METHOD FOR PROCESSING A DIGITALLY EXPOSED TRANSLUCENT OR TRANSPARENT PHOTOGRAPHIC MATERIAL

BACKGROUND OF THE INVENTION

1. Field of the Invention

The present invention relates to novel methods for processing a digitally exposed photographic translucent or transparent material. The present invention can provide a translucent or transparent material having an increased visual maximum density, and is particularly suitable for use in large format development processes.

2. Description of the Related Art

The processing of a color photographic material generally includes a color development step as the primary step for producing an image. In the color development step, silver halide exposed to light is reduced with a color developing agent to produce silver. At the same time, the oxidized color developing agent is reacted with a color former (i.e., a coupler) to form a dye image. In a subsequent desilvering step, the silver produced in the color development step is oxidized with an oxidizing agent (i.e., a bleaching agent) and then dissolved by a silver ion complexing agent (i.e., a fixing agent) to thereby provide a dye image only on the color light-sensitive material.

Both analog and digital exposure methods can be used to expose large format photographic material. An analog exposure method typically employs, for example, a tungsten lamp. Typical operation conditions of such a tungsten lamp include an exposure time of about 0.5 second and an intensity about 600 lux. A digital exposure method typically uses a digital writer to expose a photographic material. The use of such digital exposure method can provide various benefits such as, for example, enabling the use of an image stored in digital format directly with the exposure device. This can obviate the need to use an enlarger device, as is typically required in large format analog exposure methods. In addition, the use of a digital exposure method enables the images to be easily altered using any one of a number of commercially available computer programs.

One type of photographic material that can be used in digital processing is a transparent or translucent material which enables the material to be used, for example, for display purposes. Such transparent or translucent material is particularly useful in applications where the material is used in conjunction with backlighting. For example, a light source can be placed behind the transparent or translucent material and the light can pass through the material, thereby illuminating the material.

A digital exposure method is typically used in exposing such transparent or translucent material. However, the digital exposure method typically entails a higher intensity and a shorter time of exposure in comparison with conventional analog exposure (e.g., with a conventional tungsten lamp light source). The visual maximum density of the image produced on the digitally exposed transparent or translucent material is typically lower when the same material and processing conditions are applied. While not being bound by any particular theory, it is believed that this reduced density may be due to the formation of several sub-latent images which results in a less developed latent image. Thus, there exists a need to increase the visual maximum density of a transparent or translucent photographic material, preferably by relatively inexpensive means.

One attempt to address this problem is to increase the exposure time of the transparent or translucent material. However, this typically lowers the lifetime of the exposing device, with replacement costs of such device typically being relatively high. In addition, increasing the exposure time can lead to an increased stain of the materials to an undesirable degree.

Increasing the development time of the photographic material has also been proposed to address the problem of low visual density in transparent or translucent materials. However, this offsets one advantage of using digital exposure methods, i.e., providing a decreased exposure time. In addition, an increased development time can result in undesirable photographic effects, such as increased stain densities in the unexposed portions of the photographic material, which can lead to poor image quality.

Advantageously, the present invention can conspicuously ameliorate or overcome the above-described problem of low visual maximum densities obtained from the digital exposure of transparent or translucent material. For example, the inventive methods can provide improved processing of color images on transparent or translucent materials with higher optical maximum densities. The methods are particularly applicable in preparing materials for use in backlit applications. Further, the inventive methods can provide high quality photographic images using digital exposure methods without any need for employing impractically long exposure or development times.

Other objects and aspects of the present invention will become apparent to one of ordinary skill in the art upon review of the specification and claims appended hereto.

SUMMARY OF THE INVENTION

The foregoing objectives are met by the methods of the present invention. According to one aspect of the present invention, a method is provided that is suitable for use in processing a digitally exposed translucent or transparent display material. The method comprises:

(a) exposing a translucent or transparent material to light emitted from a light source, wherein the material contains at least one silver halide having a silver content of at least about 1 g/m$^2$ based on the area of the material;

(b) contacting the material with a color developer solution comprising at least one color developing agent and a compound having the following formula (I):

Formula (I)

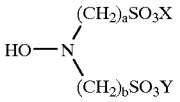

wherein each of a and b independently represents 1 to 4, and wherein each of X and Y independently represents a hydrogen, sodium or potassium atom; and wherein the duration of the step (b) is from about 60 to about 180 seconds.

DETAILED DESCRIPTION OF PREFERRED EMBODIMENTS OF THE PRESENT INVENTION

The inventive methods are capable of providing a translucent or transparent display material having an increased visual density. For example, the use of a color developer solution containing the formula (I) compound in conjunction with the processing of a translucent or transparent display material having a relatively high silver content can contribute to increasing the visual density of an image developed on the material.

The inventive methods are particularly suitable for use in processing digitally exposed translucent or transparent materials. As used herein, the terms "digitally exposed" and "digital exposure" relate to exposure conditions which are relatively short in duration and relatively high in intensity. Examples of such short duration, high intensity exposure conditions are discussed below in greater detail. In addition, the terms "digitally exposed" and "digital exposure" preferably relate to the use of images stored in digital format directly with the exposure device.

The inventive method includes exposing a translucent or transparent material with light emitted from a light source. The light source can include, for example, a laser, a light-emitting diode (LED) or a cathode ray tube (CRT). Commercially available light sources which can be used in the inventive methods include, for example, Lambda laser exposure device available from Durst Phototechnik AG, located in Italy; LightJet laser exposure device available from Cymbolic Sciences, Inc., located in San Jose, Calif.; and Chromira LED exposure device available from ZBE, Inc., located in Santa Barbara, Calif. The voltage setting of the light source can be about 1000 volts, but is not limited thereto.

Preferably, the light source can be used in conjunction with data stored in digital format to process the translucent or transparent material, more preferably without the use of an enlarger device. For example, in a preferred embodiment, a conventional tungsten lamp, which typically requires the use of an enlarger device to process large format materials, is excluded from being used in the inventive method.

In a preferred embodiment, the light source exposes the material to light for a duration not longer than about $10^{-4}$ second. For example, the duration of the exposure of the material by light emitted from the light source can be from about $10^{-8}$ to $10^{-4}$ second. The light source can be a high intensity light source providing an intensity of, for example, at least about 100,000 lux, more preferably at least about 1,000,000 lux.

The photographic material is either a translucent material or a transparent material. For example, the translucent or transparent material can be distinguished from paper material at least because paper material typically is opaque, i.e., it does not allow the transmission of light therethough. The translucent or transparent material can be formed from, for example, a plastic material. Preferably, the translucent or transparent material comprises polyester. When used in backlit applications, an exemplary translucent or transparent material typically has a higher maximum visual density requirement than that of conventional paper material. The preferred value of the visual density will at least depend on, for example, the type of material used and the particular application.

The translucent or transparent material can be used to produce a display disposed in front of an illuminator which provides the backlighting. The illuminator can be any light source such as, for example, a light bulb or a plurality of light bulbs. The translucent material can be used with an illuminator and without a diffuser, whereas the clear material is preferably used with an illuminator and a diffuser. For example, a diffuser typically diffuses the light emitted from the illuminator such that the illuminator, such as a light bulb, is not clearly visible through the transparent material. The translucent or transparent material processed by the inventive methods can be employed in various applications including, for example, signs and displays for use in advertising, menus, building directories, etc. However, the inventive method is not limited to producing materials for use in the above applications.

The translucent or transparent material can consist of a photographic silver halide emulsion having a silver content of at least about 1 g/m$^2$, based on the area of the material. The silver halide functions as a light-sensitive material and, for example, can be disposed on the surface of the translucent or transparent material by use of an emulsion coated thereon. In a preferred embodiment, the translucent or transparent material contains a silver halide having a silver content of from about 1 g/m$^2$ to about 2 g/m$^2$ based on the area of the material. The silver halide can include, for example, silver chloride, silver bromide, silver iodide or mixtures thereof.

The silver content on the translucent or transparent material can enable such material to be used in conjunction with light sources which employ relatively short exposure times such as, for example, the laser, LED and CRT described above. In addition, the silver content can potentially allow an increase in corresponding color dyes to be formed, which can be beneficial for increasing the visual density. By comparison, conventional color paper materials typically include a silver halide having a silver content from 0.4 g/m$^2$ to 0.7 g/m$^2$ based on the area of the material.

The method also includes a step of contacting the exposed translucent or transparent material with a color developer solution. The duration of the color developing step can be from about 60 to about 180 seconds, more preferably from about 100 to about 120 seconds. The temperature of the color developing solution during this process can be from about 25 to about 50° C., more preferably from about 33 to about 40° C., and most preferably about 35° C.

The color developer solution includes a compound having the following formula (I):

Formula (I)

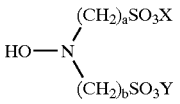

wherein each of a and b independently represents 1 to 4, and wherein each of X and Y independently represents a hydrogen, sodium or potassium atom. In a preferred embodiment, a and b each represent 2, and X and Y each represent sodium, i.e., the compound is disodium 2,2'-hydroxyimino bis(ethylenesulfonate) (HADS).

The formula (I) compound can function as a preservative of a color developing agent present in the color developing solution. For example, the formula (I) compound can reduce or prevent the oxidation of the color developing agent. Use of the formula (I) compound enables the maximum visual density of an image formed on a translucent or transparent material to be increased, which is exemplified in the Examples set forth below. Because the maximum density can be achieved without employing an impractically long development time, the stain on the material can be controlled to an acceptable level.

The formula (I) compound is preferably present in the color developer solution in an amount effective to reduce or prevent the oxidation of the color developing agent, as well as to increase the visual density resulting from the use of the color developing solution. Preferably, the formula (I) compound is present in an amount from about 0.007 to about 0.07 mole per liter of the color developer solution, more preferably from about 0.02 to about 0.04 mole per liter of the color developer solution.

In an exemplary embodiment, the color developer solution can include, in addition to the compound of formula (I), diethyl hydroxylamine (DEHA) as a preservative to reduce or prevent the oxidation of the color developing agent. DEHA can be present in an amount from 0 to about 0.04 mole per liter of the color developer solution. The amount of DEHA present in the color developer solution can depend on, for example, the amount of the formula (I) compound present in the color developer solution. In an exemplary embodiment, the color developer solution is substantially free of DEHA.

While not being bound by any particular theory, it is believed that DEHA may cause the reduction of the visual density of images formed on high-silver content translucent and transparent materials. For example, it is possible that DEHA may decrease dye formation due to its relatively high lipophilicity. Also, DEHA, because of its high reducing power, may cause the reduction of quinonediimine (which is the oxidized product of a color developing agent), thereby resulting in a decreased level of dye formation due to the decrease in quinonediimine. It is also possible that DEHA may cause a degree of black and white development on the silver halide grains, which can also result in a decreased level of dye formation.

The color developer solution preferably includes a color developing agent that is effective to develop the material. Suitable color developing agents include, for example, a para-phenylene diamine derivative in either free base or salt form, such as N-ethyl-N-(β-methylsulfonamidoethyl)-3-methyl-p-phenylenediamine; N-ethyl-N-(β-hydroxyethyl) 3-methyl-p-phenylenediamine; or mixtures thereof. A preferred para-phenylene diamine derivative is available under the tradename CD-3 from Eastman Chemical Co., located in Kingsport, Tenn. Preferably, the color developing agent can be present in the color developer solution in an amount from about 5 to about 10 grams per liter of color developer solution.

The color developer solution can also include a water-miscible or water-soluble organic solvent. For example, a water-miscible or water-soluble, hydroxyl-substituted organic solvent that has an average molecular weight from 50 to 400 can be used. The organic solvent can include, for example, ethylene glycol (EG), diethylene glycol (DEG), triethylene glycol (TEG), polyethylene glycol (PEG) such as PEG 200, 300 or 400, or mixtures thereof. Preferably, the organic solvent is present in an amount less than or equal to about 50 grams per liter of color developer solution, more preferably in an amount from about 10 to about 30 grams per liter of color developer solution. Preferably, the organic solvent can be effective to suppress stain formation on the translucent or transparent display material. This is discussed below in the Examples.

The color developer solution can contain various other materials such as, for example, an optical brightener. The optical brightener can include, for example, a stilbene derivative, which is available under the tradename BLANKOPHOR REU-P180 from Bayer Chemicals. In addition, an alkali material can be included in an amount effective to accelerate the processing of the translucent or transparent material. The alkali can include, for example, $Na_2CO_3$, $NaHCO_3$, $KHCO_3$, NaOH, KOH, LiOH or mixtures thereof.

Various materials can be added in amounts effective to reduce or prevent the oxidation of the color developing agent present in the color developer solution. For example, triethanolamine (TEA) or a TEA derivative such as triethylpropanolamine (TIPA) can be added as a protective agent to protect the color developing agent from oxidation. Additionally or alternatively, a sulfite can be added to enhance the resistance of the developing agent to oxidation. For example, the sulfite can include $Na_2SO_3$, $K_2SO_3$, $K_2S_2O_5$, $Na_2S_2O_5$ or mixtures thereof.

A sequestering agent can also be included such as, for example, EDTA, an aminopolycarboxylic acid derivative, an organic polyphosphoric acid derivative (such as DTPA and HEDPA), or mixtures thereof. A chelating agent can be added in an amount effective to bind trace amounts of iron which may be present in the solution and which typically contribute to the oxidation of the developing agent. For example, a benzenedisulfonic acid derivative such as 4,5-dihydroxy-1,3-benzenedisulfonic acid available under the tradename TIRON from Spectrum Chemical Co. located in Gardenia, Calif., can be used. A halide such as KBr or NaBr can also be included.

The color developer solution can also include a surfactant such as polyvinyl pyrrolidone (PVP K-17 in the Examples), and/or SILWET L7657 available from Crompton Corp. located in Greenwich, Conn. In addition, the color developer solution can contain an antimicrobial agent such as PROXEL GXL, available from Avecia, Inc. located in Wilmington, Del.

The pH of the color developer solution can be from about 9 to about 11. In an exemplary embodiment, the color developing solution can be formulated into a first concentrate and a second concentrate, which can be diluted with water to form a usable developer working solution. The first concentrate can have a pH as high as 12 or higher to enable a high solubility of the color developing agent. The second concentrate can be added to water and the first concentrate to adjust the pH of the developing solution to prepare the developer working solution. The pH of the second concentrate can be adjusted, for example, by adjusting the concentration of the carbonate and bicarbonate content. For example, the carbonate to bicarbonate concentration ratio can be from 0:100 to 100:0.

EXAMPLES

The visual densities, including the maximum density (Dmax) and minimum density (Dmin), achieved by the exposure of high-silver content transparent and translucent materials were compared using a color developing solution including DEHA and another color developing solution including the formula (I) compound (in particular, HADS).

The following materials were used in the present Examples:

Materials Processed in the Examples

| Material No. | Type of Material | Tradename |
|---|---|---|
| 1 | translucent | FUJITRANS CRYSTAL ARCHIVE display material (Available from Fuji Photo Film Co.) |
| 2 | translucent | PROFESSIONAL DURATRANS PLUS digital display material (available from Eastman Kodak Co.) |
| 3 | translucent | ILFORTRANS 2000 PLUS translucent display material (available from Ilford Imaging USA, Inc.) |
| 4 | trans-parent | ILFORCLEAR 2000 PLUS display material (available from Ilford Imaging USA, Inc.) |
| 5 | color paper | FUJI PROFESSIONAL CRYSTAL ARCHIVE paper type CD (Available from Fuji Photo Film Co.) |

In each of the examples, the exposure was conducted with a simulated laser light source employed at 1000 volts using a flash exposure duration of 1/10000 second. The developing step was conducted for 110 seconds at 35° C. The bleach-fix step was conducted for 110 seconds at 35° C., using COLORPRINT RA bleach fix solution, available from Fuji Hunt Photographic Chemicals, Inc., located in Allendale, N.J. The processed material was washed with water for 6 minutes and 10 seconds at a temperature ranging from 30 to 35° C. Visual density was measured using an X-RITE 310 densitometer, available from X-Rite, Inc. located in Grandville, Mich.

Example 1

Comparison of the Visual Densities of Materials Processed with Color Developer Solutions Containing HADS and DEHA To determine the effect of adding the formula (I) compound to a color developer solution used to develop a high-silver content transparent or translucent material, an inventive color developer solution (Sample 1-1) containing HADS and a comparative color developer solution (Sample 1-2) containing DEHA were formed. Each of these samples was formed by adding to 700 ml DI water each of the components set forth in Table 1, and thoroughly mixing the resulting mixture. DI water was then added to reach a total volume of 980 ml. Subsequently, 10.15 g of 45% KOH was added to adjust the pH of the mixtures, and DI water was added to reach a total volume of 1000 ml. As can be seen from Table 1, the Samples 1-1 and 1-2 were identical, with the exception of the presence of HADS in Sample 1-1 and DEHA in Sample 1-2.

TABLE 1

Components Used in the Formation of Samples 1-1 and 1-2

| Component | Sample 1-2 | Sample 1-1 |
|---|---|---|
| NaCl | 0.82 g | 0.82 g |
| KBr, 1% (10 g/L, prepared) | 4.4 ml | 4.4 ml |
| $CaCl_2$ | 0.15 g | 0.15 g |
| $MgCl_2.6H_2O$, 1% (10 g/L, prepared) | 23 ml | 23 ml |
| $Na_2SO_4$ | 0.94 g | 0.94 g |
| EDTA · 2Na salt | 3.45 g | 3.45 g |
| TIRON | 0.50 g | 0.50 g |
| TEA, 85% | 14.12 g | 14.12 g |
| PROXEL GXL, 7% | 0.92 g | 0.92 g |
| BLANKOPHOR P-180 | 1.54 g | 1.54 g |
| DEG | 20.00 g | 20.00 g |
| DEHA | 0.0504 mole | 0 |
| HADS | 0 | 0.0171 mole |
| $Na_2SO_3$ | 0.02 g | 0.02 g |
| $K_2CO_3$, 47% | 51.06 g | 51.06 g |
| CD-3 | 5.64 g | 5.64 g |

The maximum and minimum densities of Materials 2–4 processed with Samples 1-1 and 1-2 were measured, and the measurements are set forth in Tables 2 and 3, respectively. As can be seen from Table 2, the maximum density of each of Materials 2–4 processed with Sample 1-1 was significantly higher in comparison with the maximum density when processed with Sample 1-2. Referring to Table 3, there was generally no significant difference between the minimum density values obtained using Sample 1-1 in comparison with Sample 1-2. These results show that using a color developer solution which includes the formula (I) compound, e.g., HADS, in conjunction with a transparent or translucent material having a relatively high silver content can provide an increased maximum density in comparison with the use of a conventional color developer solution which includes DEHA.

TABLE 2

Maximum Density of Various Materials Processed with Samples 1-1 and 1-2

| Material | [Silver] | Dmax - Sample 1-2 | | | | Dmax - Sample 1-1 | | | |
|---|---|---|---|---|---|---|---|---|---|
| | $g/m^2$ | blue | green | red | visual | blue | green | red | visual |
| 2 | 1.53 | 3.94 | 4.20 | 4.40 | 4.09 | 4.20 | 4.85 | 4.65 | 4.54 |
| 3 | 1.51 | 4.33 | 4.14 | 4.04 | 3.94 | 4.66 | 4.57 | 4.23 | 4.23 |
| 4 | 1.40 | 3.69 | 3.76 | 3.28 | 3.29 | 3.88 | 4.18 | 3.51 | 3.55 |

TABLE 3

Minimum Density of Various Materials Processed with Samples 1-1 and 1-2

| Material | [Silver] | Dmin - Sample 1-2 | | | | Dmin - Sample 1-1 | | | |
|---|---|---|---|---|---|---|---|---|---|
| | $g/m^2$ | blue | green | red | visual | blue | green | red | visual |
| 2 | 1.53 | 0.417 | 0.363 | 0.332 | 0.370 | 0.417 | 0.363 | 0.331 | 0.370 |
| 3 | 1.51 | 0.418 | 0.351 | 0.322 | 0.352 | 0.417 | 0.352 | 0.321 | 0.351 |
| 4 | 1.40 | 0.087 | 0.068 | 0.050 | 0.061 | 0.087 | 0.067 | 0.048 | 0.060 |

Example 2

Formation of a Color Developer Solution from a Two-Part Concentrate

To determine the effect of adding the formula (I) compound to a color developer solution formed from a two component system, an inventive color developer concentrate (Concentrate A-1) containing HADS and a comparative concentrate (Concentrate A-2) containing DEHA were formed. Each of these concentrates was formed by adding the components set forth in Table 4 to 500 ml DI water, and thoroughly mixing the resulting mixture. DI water was added to reach a total volume of 1000 ml. 50% NaOH was used to adjust the pH of the concentrates to 13.00 (at 25° C.). Referring to Table 4, the Concentrates A-1 and A-2 were identical, with the exception of the presence of HADS in Concentrate A-1 and DEHA in Concentrate A-2.

TABLE 4

Formation of Developer Concentrates A-1 and A-2

| Component | Concentrate A-2 | Concentrate A-1 |
|---|---|---|
| PVP K-17 | 10.00 g | 10.00 g |
| SILWET L7657 | 1.00 g | 1.00 g |
| Sodium Bromide | 2.02 g | 2.02 g |
| TIRON | 5.00 g | 5.00 g |
| HADS | 0 | 0.2558 mole |
| DEHA | 0.7295 mole | 0 |
| BLANKOPHOR REU-P180 | 19.20 g | 19.20 g |
| Sodium Hydroxide, 50% | 65.00 g | 65.00 g |
| CD-3 | 68.30 g | 68.30 g |

The second component (Part B) to be used with both of Concentrates A-1 and A-2 was formed by adding the components set forth in Table 5 to 400 ml DI water, and mixing the resulting mixture. DI water was added to the resulting mixture to reach a total volume of 1000 ml. The mixture was then pH-adjusted to 10.47 (at 25° C.).

TABLE 5

Formation of Part B

| Component | Amount |
|---|---|
| Potassium Carbonate, 47% | 529.76 g |
| EDTA | 37.50 g |
| Potassium Bromide | 0.41 g |
| Sodium Bicarbonate | 31.00 g |
| Triethanolamine, 85% | 176.50 g |

Two developer replenishers were formed from Concentrates A-1 and A-2, and Part B. In this regard, Developer Replenisher 1 (DR 1) was formed by mixing 700 ml DI water, 100 ml of Concentrate A-1 and 80 ml of Part B. Subsequently, DI water was added to reach a total volume of 1000 ml. The resulting mixture was pH-adjusted to 10.70 (at 25° C.). Developer replenisher 2 (DR 2) was formed by mixing 700 ml DI water, 100 ml of Concentrate A-2 and 80 ml of Part B, and then DI water was added to reach a total volume of 1000 ml. The resulting mixture was pH-adjusted to 10.70 (at 25° C.).

Two developer tank solutions were prepared from DR 1 and DR 2. In this regard, Developer Tank Solution 1 (DTS 1) was formed by mixing 800 ml of DR 1 and 25 ml of a developer starter CP/RA/RA-100, available from Fuji Hunt Photochemicals located in Allendale, N.J. DI water was then added to the resulting mixture to reach a total volume of 1000 ml. The resulting mixture was pH-adjusted to 10.15 (at 25° C.). Developer tank solution 2 (DTS 2) was formed by mixing 800 ml of DR 2 and 25 ml of the developer starter CP/RA/RA-100. DI water was added to the resulting mixture to reach a total volume of 1000 ml. The resulting mixture was pH-adjusted to 10.15 (at 25° C.).

The visual density of Material 1 was measured when processed with DTS 1 and DTS 2 at various time intervals from 45 to 270 seconds. Material 1 had a silver content of 1.49 g/m$^2$, and the material was developed at a temperature of 35° C. The measured visual density values of the material are set forth in Table 6:

TABLE 6

Visual Densities of Material 1 Processed with DTS 1 and DTS 2

| Development Time | Dmax | | Dmin | |
|---|---|---|---|---|
| (sec.) | DTS 2 | DTS 1 | DTS 2 | DTS 1 |
| 45 | 3.60 | 3.61 | 0.400 | 0.400 |
| 70 | 3.69 | 4.05 | 0.401 | 0.401 |
| 110 | 3.80 | 4.21 | 0.402 | 0.401 |
| 140 | 3.91 | 4.27 | 0.407 | 0.402 |
| 180 | 3.95 | 4.31 | 0.415 | 0.403 |
| 210 | 3.96 | 4.32 | 0.426 | 0.405 |
| 240 | 3.94 | 4.31 | 0.435 | 0.406 |
| 270 | 3.94 | 4.31 | 0.446 | 0.408 |

As can be seen from Table 6, DTS 1 provided an increased maximum visual density, especially when a development time of from 70 to 180 seconds was employed, in comparison with DTS 2. Also, in a development time range from 70 to 180 seconds, the minimum visual density of DTS 1 was comparable to that achieved from using DTS 2. These results show that the use of the formula (I) compound (and in particular HADS) in conjunction with a material having a relatively high silver content (1.49 g/m$^2$) can provide an increased maximum visual density in comparison with a conventional developer tank solution which employs DEHA.

The visual density of Material 5 was measured when processed with DTS 1 and DTS 2 at various time intervals from 45 to 270 seconds. Material 5 had a silver content of 0.57 g/m$^2$, and the material was developed at a temperature of 35° C. The measured visual density values are set forth in Table 7:

TABLE 7

Visual Densities of Material 5 Processed with DTS 1 and DTS 2

| Development Time | Dmax | | Dmin | |
|---|---|---|---|---|
| (sec.) | DTS 2 | DTS 1 | DTS 2 | DTS 1 |
| 45 | 2.60 | 2.61 | 0.090 | 0.090 |
| 70 | 2.59 | 2.60 | 0.092 | 0.090 |
| 110 | 2.60 | 2.60 | 0.097 | 0.091 |
| 140 | 2.60 | 2.60 | 0.100 | 0.091 |
| 180 | 2.61 | 2.60 | 0.103 | 0.091 |
| 210 | 2.60 | 2.60 | 0.106 | 0.092 |
| 240 | 2.60 | 2.61 | 0.110 | 0.092 |
| 270 | 2.60 | 2.60 | 0.115 | 0.093 |

As can be seen from Table 7, DTS 1 did not provide a significant increase in maximum visual density in comparison with DTS 2 when the material used had a relatively low silver content (0.57 g/m$^2$). These results underscore the surprising and unexpected nature of the results from using a color developer solution containing the formula (I) compound in conjunction with a material having a relatively high silver content (for example, 1.49 g/m$^2$) discussed above.

Example 3

Effect of an Organic Solvent on Suppressing the Stain of Translucent and Transparent Materials Color developer solutions were prepared containing various amounts of an organic solvent, in particular DEG. The color developer solutions were used to process Materials 2 to 4 to determine the effect of DEG on suppressing the stain of translucent and transparent materials.

Four color developer solutions (Reference Sample, Sample 3-1, Sample 3-2 and Sample 3-3) were formed with the components set forth in Table 8. In this regard, the components in Table 8 were added to 700 ml DI water and the resulting mixture was mixed thoroughly. DI water was added to reach a total volume of 980 ml. Thereafter, 10.15 g of 45% KOH was added to pH-adjust the solution, and DI water was added to reach a total volume of 1000 ml. The color developer solutions were used to process Materials 2-4 and the stain levels produced thereby are set forth in Table 9.

TABLE 8

Formation of Reference Sample and Samples 3-1 to 3-3

| Component | Reference Sample | Sample 3-1 | Sample 3-2 | Sample 3-3 |
|---|---|---|---|---|
| NaCl | 0.82 g | 0.82 g | 0.82 g | 0.82 g |
| KBr, 1% (10 g/L, prepared) | 4.4 ml | 4.4 ml | 4.4 ml | 4.4 ml |
| $CaCl_2$ | 0.15 g | 0.15 g | 0.15 g | 0.15 g |
| $MgCl_2.6H_2O$, 1%) 10 g/L, prepared) | 23 ml | 23 ml | 23 ml | 23 ml |
| $Na_2SO_4$ | 0.94 g | 0.94 g | 0.94 g | 0.94 g |
| EDTA · 2Na Salt | 3.45 g | 3.45 g | 3.45 g | 3.45 g |
| TIRON | 0.50 g | 0.50 g | 0.50 g | 0.50 g |
| TEA, 85% | 14.12 g | 14.12 g | 14.12 g | 14.12 g |
| PROXEL GXL, 7% | 0.92 g | 0.92 g | 0.92 g | 0.92 g |
| BLANKOPHOR REU-P180 | 1.54 g | 1.54 g | 1.54 g | 1.54 g |
| DEG | 0.00 g | 10.00 g | 20.00 g | 30.00 g |
| HADS | 0.0171 mole | 0.0171 mole | 0.0171 mole | 0.0171 mole |
| $Na_2SO_3$ | 0.02 g | 0.02 g | 0.02 g | 0.02 g |
| $K_2CO_3$, 47% | 51.06 g | 51.06 g | 51.06 g | 51.06 g |
| CD-3 | 5.64 g | 5.64 g | 5.64 g | 5.64 g |

Referring to Table 9, each of Samples 3-1 to 3-3 (which employed DEG) produced a reduced stain level in comparison with the stain produced by the Reference Sample, which did not contain DEG. In addition, an increase in the amount of DEG present in the color developer solution generally decreased the stain level, as can be seen from comparing the results of Sample 3-1 with Sample 3-3. These results show that an organic solvent such as DEG can be used as an effective stain suppressing agent in the inventive methods.

TABLE 9

Minimum Density of Various Materials Processed with Reference Sample and Samples 3-1 to 3-3

| Material | [Silver] g/m$^2$ | Dmin | Reference Sample [DEG] = 0 g/L | Sample 3-1 [DEG] = 10 g/L | Sample 3-2 [DEG] = 20 g/L | Sample 3-3 [DEG] = 30 g/L |
|---|---|---|---|---|---|---|
| 2 | 1.53 | Blue | 0.422 | 0.419 | 0.417 | 0.414 |
| | | Green | 0.370 | 0.366 | 0.364 | 0.363 |
| | | Red | 0.337 | 0.334 | 0.332 | 0.330 |
| | | Visual | 0.376 | 0.373 | 0.371 | 0.368 |
| 3 | 1.51 | Blue | 0.423 | 0.419 | 0.417 | 0.416 |
| | | Green | 0.357 | 0.355 | 0.352 | 0.350 |
| | | Red | 0.328 | 0.323 | 0.321 | 0.319 |
| | | Visual | 0.360 | 0.356 | 0.353 | 0.351 |
| 4 | 1.40 | Blue | 0.093 | 0.090 | 0.087 | 0.086 |
| | | Green | 0.072 | 0.070 | 0.067 | 0.065 |
| | | Red | 0.054 | 0.051 | 0.047 | 0.045 |
| | | Visual | 0.066 | 0.063 | 0.060 | 0.058 |

Example 4

Effect of Adding DEHA to a Color Developer Solution Containing the Formula (1) Compound Concentrates A-1, A-2 and Part B formed in Example 2, discussed above, were used to produce the developer replenishers shown in Table 10 (Reference DR, DR 4-1, DR 4-2 and DR 4-3), except that 200 g of DEG were added to each of Concentrates A-1 and A-2. Each developer replenisher was formed by adding the components listed in Table 10 to 700 ml of DI water and mixing thoroughly. DI water was then added to reach a total volume of 1000 ml, and the resulting mixture was pH-adjusted to 10.70 (at 25° C.).

TABLE 10

Formation of Developer Replenishers

| Component | Reference DR | DR 4-1 | DR 4-2 | DR 4-3 |
|---|---|---|---|---|
| Concentrate A-1 | 100 ml | 0 | 0 | 0 |
| Concentrate A-2 | 0 | 100 ml | 100 ml | 100 ml |
| Component B | 80 ml | 80 ml | 80 ml | 80 ml |
| DEHA | 0 | 0 | 0.0365 mole | 0.0729 mole |

The above developer replenishers were used to form corresponding developer tank solutions. In particular, Reference DR and DR 4-1 to 4-3 were used to form a Reference DTS and DTS 4-1 to 4-3, respectively. In this regard, 800 ml of each of the above replenishers and 25 ml of the developer starter CP RA/RA-100 were mixed together. DI water was added to each of the resulting mixtures to reach a total volume of 1000 ml, and each mixture was pH-adjusted to 10.15 (at 25° C.).

Each of the developer tank solutions was used to process Material 1 to determine the effect of adding various amounts of DEHA to a developer tank solution containing the formula (I) compound. The results are shown in Table 11:

TABLE 11

Effect on Visual Density of Adding Various Amounts of DEHA to a Color Developer Solution Containing HADS

| Developer Tank Solution | Visual Dmax | Visual Dmin |
|---|---|---|
| Reference DTS | 3.86 | 0.394 |
| DTS 4-1 | 4.25 | 0.393 |
| DTS 4-2 | 4.06 | 0.393 |
| DTS 4-3 | 3.87 | 0.393 |

As can be seen from Table 11, DTS 4-1 which contained no DEHA exhibited the highest visual maximum density. DTS 4-3 which contained both HADS and 0.0927 mole of additional DEHA, exhibited a visual maximum density comparable to that of the reference DTS. This shows that while DEHA can be added to a developer tank solution containing the formula (I) compound, adding an excessive amount of DEHA can negate the beneficial effect of the formula (I) compound on the maximum visual density.

While the invention has been described in detail with reference to specific embodiments thereof, it will be apparent to one skilled in the art that various changes and modifications can be made, and equivalents employed without departing from the scope of the claims.

What is claimed is:

1. A method suitable for use in processing a digitally exposed translucent or transparent display material, comprising:

(a) digitally exposing a translucent or transparent display material to light emitted from a light source, wherein the material contains at least one silver halide having a silver content of at least about 1 g/m$^2$ based on the area of the materials, wherein the duration of the step (a) is from about $10^{-4}$ to about $10^{-8}$ seconds; and (b) contacting the material with a color developer solution comprising at least one color developing agent and a compound having the following formula (I):

Formula (I)

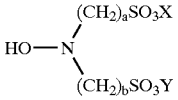

wherein each of a and b independently represents 1 to 4, and wherein each of X and Y independently represents a hydrogen, sodium or potassium atom; and wherein the duration of the step (b) is from 110 to about 180 seconds.

2. The method of claim 1, wherein in the formula (I) compound, a and b represent 2, and X and Y represent sodium.

3. The method of claim 1, wherein the silver content is from about 1 to about 2 g/m$^2$ based on the area of the material.

4. The method of claim 1, wherein the light source comprises a laser, a light-emitting diode or a cathode ray tube.

5. The method of claim 1, wherein the color developer solution comprises the formula (I) compound from about 0.007 to about 0.07 mole per liter of the color developer solution.

6. The method of claim 5, wherein the color developer solution comprises the formula (I) compound from about 0.02 to about 0.04 mole per liter of the color developer solution.

7. The method of claim 1, wherein the color developer solution comprises DEHA from 0 to about 0.04 mole per liter of the color developer solution.

8. The method of claim 7, wherein the color developer solution is substantially free of DEHA.

9. The method of claim 1, wherein the step (b) is conducted at a temperature from about 33 to about 40° C.

10. The method of claim 1, wherein the color developing agent comprises a para-phenylene diamine derivative in either free base or salt form.

11. The method of claim 10, wherein the para-phenylene diamine derivative in either free base or salt form comprises N-ethyl-N-β-methylsulfonamidoethyl)-3-methyl-p-phenylenediamine, N-ethyl-N-(β-hydroxyethyl) 3-methyl-p-phenylenediamine or a mixture thereof.

12. The method of claim 1, wherein the color developing agent is present in an amount from about 5 to about 10 grams per liter of the color developer solution.

13. The method of claim 1, wherein the color developer solution further comprises a water-miscible or water-soluble, hydroxyl-substituted organic solvent.

14. The method of claim 13, wherein the organic solvent comprises a material selected from the group consisting of ethylene glycol, diethylene glycol, triethylene glycol, polyethylene glycol and mixtures thereof.

15. The method of claim 13, wherein the organic solvent is present in an amount from about 10 to about 30 grams per liter of the color developer solution.

16. The method of claim 1, wherein the pH of the color developer solution is from about 9 to about 11.

17. The method of claim 1, wherein the silver halide is selected from the group consisting of silver chloride, silver bromide, silver iodide and mixtures thereof.

* * * * *